US005149247A

United States Patent [19]

Gros et al.

[11] Patent Number: 5,149,247

[45] Date of Patent: Sep. 22, 1992

[54] SINGLE HP-MP INTERNAL STATOR FOR A STEAM TURBINE WITH CONTROLLED STEAM CONDITIONING

[75] Inventors: Jean-Pierre Gros, Villemomble; Patrick Laffont, Privas, both of France

[73] Assignee: GEC Alsthom SA, Paris, France

[21] Appl. No.: 515,017

[22] Filed: Apr. 26, 1990

[30] Foreign Application Priority Data

Apr. 26, 1989 [FR] France ..... 89 05543

[51] Int. Cl.[5] ..... F01D 5/14

[52] U.S. Cl. ..... 415/108; 415/114; 415/116; 415/177; 60/653; 60/677; 60/679

[58] Field of Search ..... 415/108, 114, 116, 117; 60/653, 677, 679

[56] References Cited

U.S. PATENT DOCUMENTS

| | | | |
|---|---|---|---|
| 1,773,909 | 8/1930 | Korb | 415/177 X |
| 2,796,231 | 6/1957 | Hertl | 415/108 |
| 2,823,891 | 2/1958 | Baker et al. | 415/108 X |
| 3,746,463 | 7/1973 | Stock et al. | 415/108 X |
| 3,754,836 | 8/1973 | Bocter et al. | 415/108 X |
| 3,773,431 | 11/1973 | Bellati et al. | 415/108 |
| 4,053,254 | 10/1977 | Chaplin et al. | 415/116 |
| 4,362,464 | 12/1982 | Stock | 415/108 X |
| 4,628,693 | 12/1986 | Riollet | 60/677 X |
| 4,844,688 | 7/1989 | Clough et al. | 415/116 |
| 4,893,983 | 1/1990 | McGreehan | 415/116 X |

FOREIGN PATENT DOCUMENTS

| | | | |
|---|---|---|---|
| 524202 | 11/1953 | Belgium . | |
| 572185 | 11/1958 | Belgium | 60/679 |
| 114351 | 2/1963 | Fed. Rep. of Germany . | |
| 2228313 | 12/1973 | Fed. Rep. of Germany | 415/101 |
| 1100792 | 9/1955 | France . | |
| 1134328 | 4/1957 | France . | |
| 1425686 | 12/1965 | France . | |
| 0191401 | 11/1982 | Japan | 415/116 |
| 0247001 | 12/1985 | Japan | 415/114 |
| 0040403 | 2/1986 | Japan | 415/116 |
| 324496 | 11/1957 | Switzerland . | |
| 331946 | 8/1958 | Switzerland . | |
| 360076 | 3/1962 | Switzerland . | |
| 435319 | 10/1967 | Switzerland . | |

*Primary Examiner*—Edward K. Look
*Assistant Examiner*—Todd Mattingly
*Attorney, Agent, or Firm*—Sughrue, Mion, Zinn, Macpeak & Seas

[57] ABSTRACT

The HP-MP steam turbine body has a single internal stator surrounding both the HP and the MP portions of the rotor. The internal stator co-operates with the external stator to define axial positioning means for the internal stator and to define a thermal screen for an inter-stator space which is swept with steam taken from one of the last stages of the HP stream. The portions of the internal stator which surround all of the expansion of the HP stream and the hot stages of the MP stream are steam-conditioned in optimum manner, thereby making it possible to reduce the temperature gradient which the internal stator has to withstand, and also the temperature of the fastenings for both of the stators. The internal stator is simple in structure, the dimensioning of the HP-MP body is optimized, as are the fastenings, and the temperature control of the stators.

6 Claims, 5 Drawing Sheets

FIG. 1 PRIOR ART 5149247
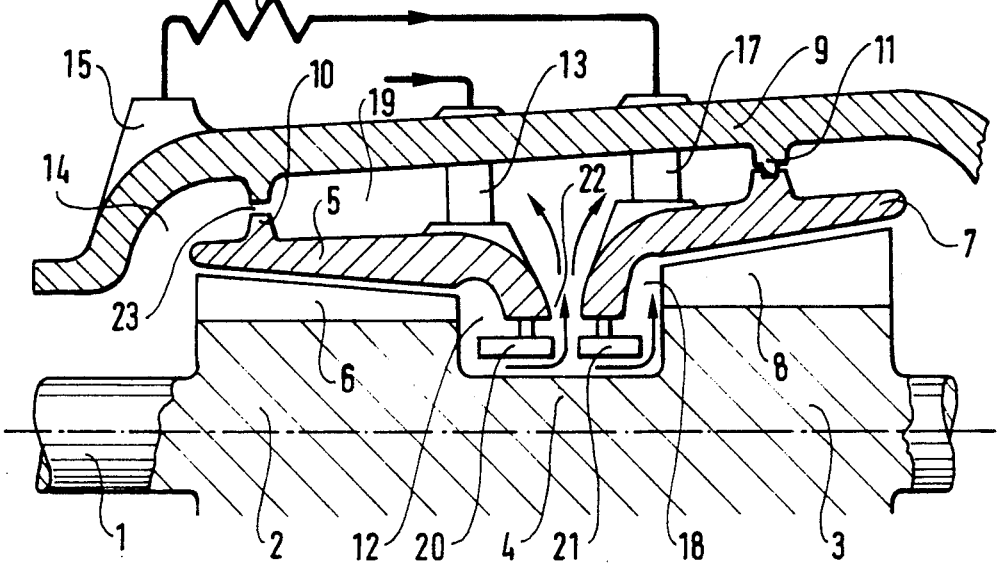
FIG. 2
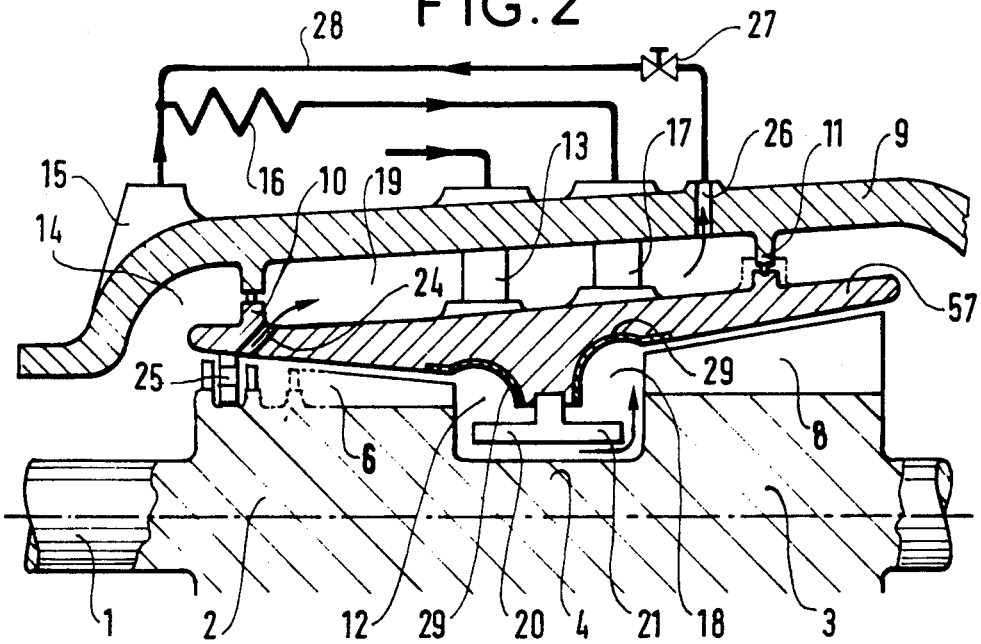

SINGLE HP-MP INTERNAL STATOR FOR A STEAM TURBINE WITH CONTROLLED STEAM CONDITIONING

FIELD OF THE INVENTION

The present invention relates to an HP-MP steam turbine body comprising a rotor having an HP portion and an MP portion interconnected by an intermediate portion;

an HP internal stator co-operating with the HP portion of the rotor to define an HP stream;

an MP internal stator co-operating with the MP portion of the rotor to define an MP stream;

the HP internal stator and the MP internal stator being positioned axially inside an external stator by sealed axial positioning means situated around the MP stream in a plane which is at a distance from the inlet of said MP stream;

thermal protection means being situated around the HP stream in a plane at a distance from the inlet of said HP stream, said positioning means and said thermal protection means co-operating with the external stator and with the HP and MP internal stators to define an inter-stator space swept by steam;

HP admission means opening out to the inlet of the HP stream;

MP admission means opening out to the inlet of the MP stream and fed with a flow of steam taken off from the outlet of the HP stream and passed through a resuperheater device;

the inlets of the HP and MP streams being adjacent to each other and separated by sealing means supported by the internal stators and disposed in the intermediate portion of the rotor between the HP and MP portions.

BACKGROUND OF THE INVENTION

In prior turbine bodies, the internal high pressure (HP) and medium pressure (MP) stators are separated by a gap and each of them is provided with a separate sealing device, which devices are separate from each other and serve to reduce the natural leakage of steam from the HP stream to the MP stream. A portion of the leakage passes through the gap between the two sealing devices and is exhausted via the gap provided between the two internal stators in the inter-stator space. This space is thus swept with high temperature steam which is exhausted via thermal protection means.

This flow of steam serves to steam condition the internal and external stators, thereby making it possible to reduce the temperature of the external stator and thus making it possible to reduce its dimensions.

However, the steam conditioning performed in this way by steam sweeping is not perfect. The temperature of the steam injected into the inter-stator space is high, and as a result both the external stator and the fastenings of the HP and MP internal stators are at high temperature.

SUMMARY OF THE INVENTION

These drawbacks are avoided by the turbine body of the invention wherein the HP internal stator and the MP internal stator constitute a single internal stator, and wherein the inter-stator space includes firstly steam admission means fed with steam taken from one of the last stages of the HP stream and opening out in the vicinity of the thermal protection means which isolate the inter-stator space from the outlet of the HP stream, and secondly steam exhaust means whose orifices are disposed in the vicinity of the axial positioning means, the said exhaust means being provided with flow adjustment means.

Steam conditioning both the internal and external stators by taking steam at lower temperature from one of the stages of the HP stream, makes it possible to reduce the temperature which the external stator must withstand and also to reduce the temperature which must be withstood by the fastenings for the external stator and for the HP-MP internal stator.

The steam sweeping through the inter-stator space thus flows through all of the space, from the axial positioning means to the thermal protection means.

Finally, since there is no longer a gap between the HP internal stator and the MP internal stator, these two stators are replaced by a single internal stator, thereby reducing axial size.

The exhaust means are provided with means for adjusting the steam flow rate which serve to adapt the steam conditioning to the desired level.

The means for exhausting this steam are connected to the inlet of the resuperheater device feeding the MP stream.

In an improvement of the invention, at least a portion of the surface of the internal stator facing the rotor between the HP and MP streams is provided with a coating having low thermal conductivity.

This reduces the thermal stresses transmitted to the internal stator in the hottest portion of the HP and MP streams.

In a preferred embodiment of the invention, the steam take-off means sending said steam into the inter-stator space are constituted by ducts provided through the projections of the internal stator which are disposed symmetrically about the axis of the turbine.

The means for exhausting steam from the inter-stator space comprise:

grooves formed in the portion of the axial positioning means which are fixed to the internal stator and opening out into cavities formed in the portion of the axial positioning means which are fixed to the external stator; and flues passing through the external stator and opening out into said cavities, the said flues being provided with dipping pipework connected to the inlet of the resuperheater device.

The external stator is thus protected from excessive convection.

BRIEF DESCRIPTION OF THE DRAWINGS

An embodiment of the invention is described by way of example with reference to the accompanying drawings, in which:

FIG. 1 is an axial half-section through a prior HP-MP turbine body;

FIG. 2 is an axial half-section through an HP-MP turbine body of the invention;

DETAILED DESCRIPTION

Figure 3:
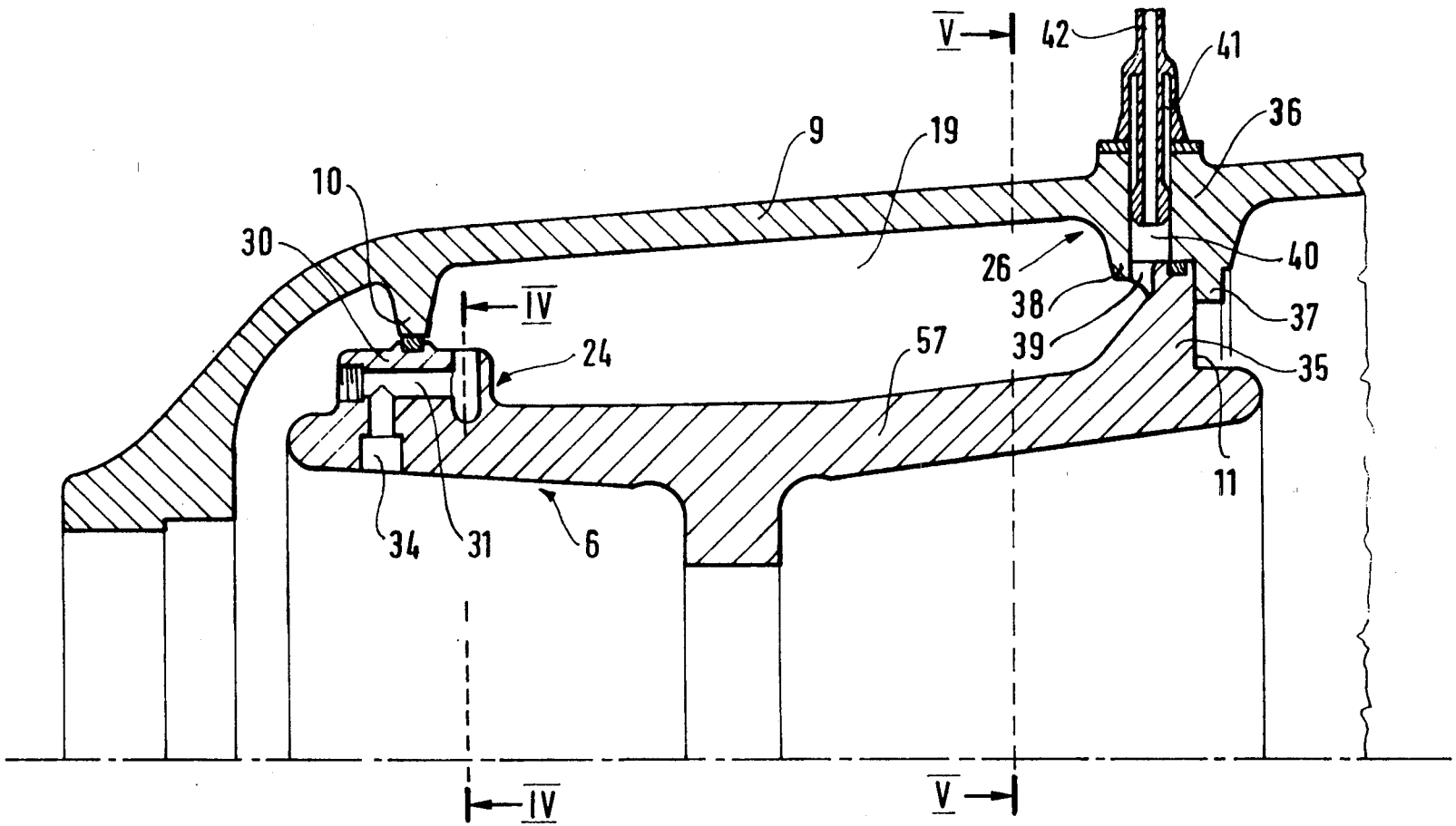
FIG. 3 is a detailed axial half-section through a preferred embodiment of the invention.

The prior art turbine body shown in FIG. 1 comprises a single rotor 1 having an HP portion 2 and an MP portion 3 separated by a portion 4 which receives the sealing means.

An HP stream 6 is defined by the HP portion 2 in conjunction with an HP internal stator 5.

An MP stream 8 is defined by the MP portion 3 in conjunction with an MP internal stator 7.

The two internal stators 5 and 7 are interconnected. They are axially positioned inside an external stator 9 by sealed positioning means 11.

In addition, the hot portions of the HP and MP internal stators 5 and 7 are thermally protected by a non-sealed screen 10.

Steam is injected into the inlet 12 of the HP stream 6 via admission means 13.

An HP exhaust 15 is disposed at the outlet 14 of the HP stream 6 and is connected via a resuperheater device 16 to MP admission means 17 feeding the inlet 18 for the MP stream 8.

The external stator 9 and the internal stators 5 and 7 together with the positioning means 11 and the thermal screen 10 define an inter-stator space 19.

The axial positioning means 11 and the thermal screen 10 are at a distance from the inlets 12 and 18 of the HP and MP streams 6 and 8 such that the inter-stator space 19 surrounds all of the hot stages of the HP and MP streams 6 and 8.

Sealing members 20 and 21 are disposed over the portion 4 in order to separate the inlet 12 of the HP stream 6 from the inlet 18 of the MP stream 8.

These two members 20 and 21 are spaced apart axially by a gap 22 between the internal stators 5 and 7 in order to allow the inter-stator space 19 to be fed with steam.

The steam entering via the gaps 22 escapes towards the outlet 14 of the HP stream 6 via a slot 23 provided through the screen 10.

This steam conditions the internal and external stators, thereby reducing the temperature gradient that needs to be withstood by the internal stators 5 and 7, thus reducing stresses.

However, because of the high temperature of the injected steam, the external stator 9 and the fastenings of the internal stators are at high temperature.

In addition, experience shows that the cold steam from the HP exhaust passes through the thermal screen 10 into the inter-stator space 19, thereby setting up asymmetrical temperatures and corresponding stresses in the hot portions of the HP and MP internal stators.

The HP-MP turbine body of the invention is shown in FIG. 2.

Those items of this turbine body which are similar to corresponding items of the prior art turbine body shown in FIG. 1 are given the same references.

The turbine body of the invention has a single internal stator 57. The sealing means 20 and 21 disposed in the portion 4 are constituted by a single piece.

The axial positioning means 11 are sealed, and likewise the thermal protection means 10 are also sealed.

The inter-stator space 19 surrounds substantially all of the stages of the HP stream 6 and the hot stages of the MP stream 8.

Admission 24 is provided into the inter-stator space through the internal stator 57 in the vicinity of the thermal protection means 10. The steam conveyed into the space 19 by this admission is taken off from the outlet of one of the last stages of the HP stream 6, e.g. upstream from the last stage 25.

An exhaust 26 is provided through the external stator 9 and is connected to the HP exhaust 15 by a duct 28 provided with an adjustment device 27. This device may be a perforated plate or a valve.

The steam which escapes from the inter-stator space is thus recycled through the resuperheater device 16.

By an appropriate choice of the HP stream stage from which steam is taken off, it is possible to obtain the desired order of magnitude for the temperature of the steam sweeping through the inter-stator space 19.

The adjustment member 27 serves to adjust temperature distribution along the axis more accurately. In general there are several exhausts 26 disposed symmetrically around the axis, each being connected to a duct 28 provided with an adjustment member 27. By adjusting the members 27 differently, it is possible to adjust the cooling of the inter-stator space 19 in azimuth.

In this way, the flow of steam sweeping through the inter-stator space conditions the internal stator 57 and the external stator 9 in optimum manner making it possible to obtain a low temperature gradient across the internal body 57 and also to obtain low temperatures for its fastenings and for the external stator. This makes it possible to use an external stator 9 and bolts which are smaller in size.

In addition, the sealing of the thermal protection device 10 protects the hot portions from any random ingress of cold steam coming from the outlet of the HP stream.

In addition, the internal stator is simpler in construction.

The portion of the internal stator 57 in the vicinity of the inlet 12 to the HP stream 6 is coated with a coating 26 of low thermal conductivity. Similarly, the portion of the internal stator 57 in the vicinity of the inlet 18 to the MP stream 8 is provided with a coating 29 of low thermal conductivity.

Figure 4:
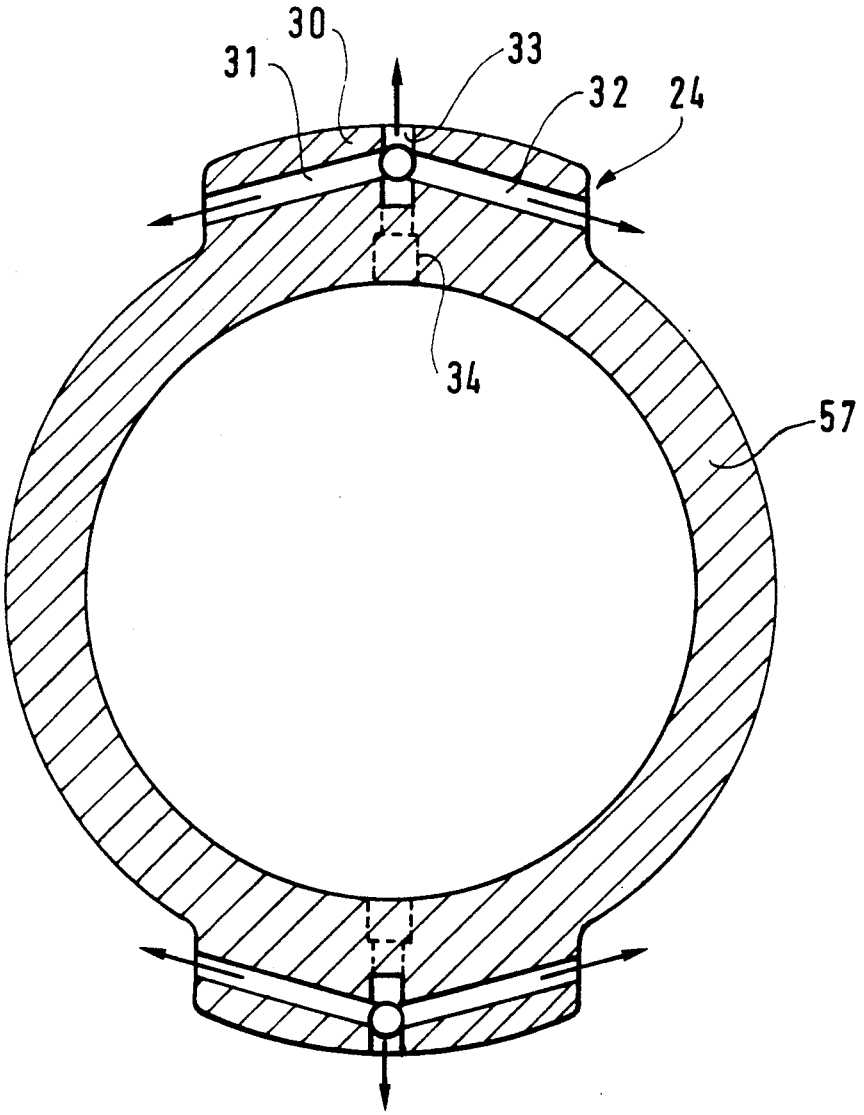
FIG. 4 is a fragmentary section on plane IV—IV of the body shown in FIG. 3.
Figure 5:
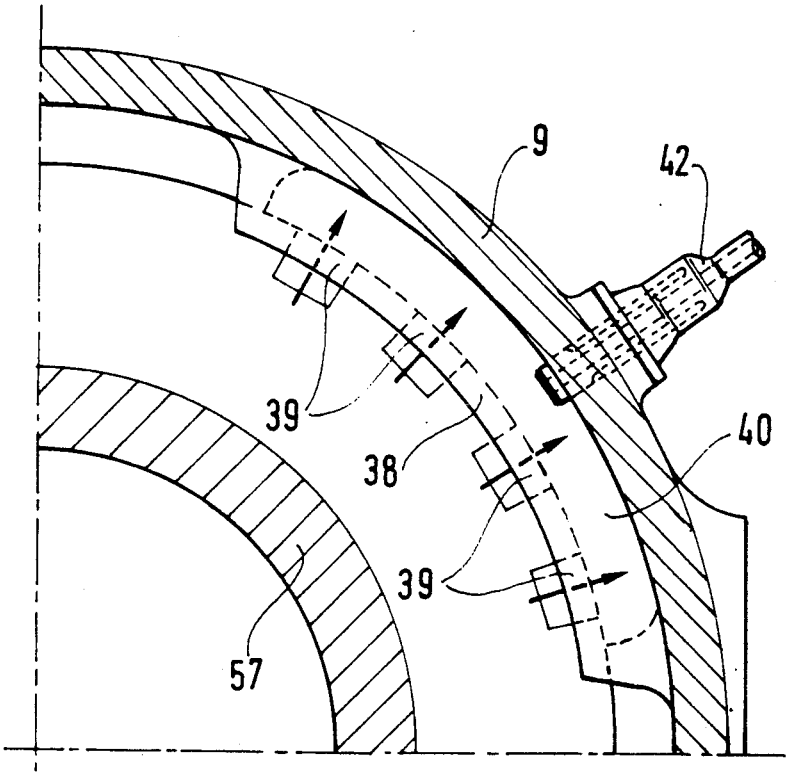
FIG. 5 is a fragmentary cross-section on plane V—V of the body shown in FIG. 3.
Figure 6:
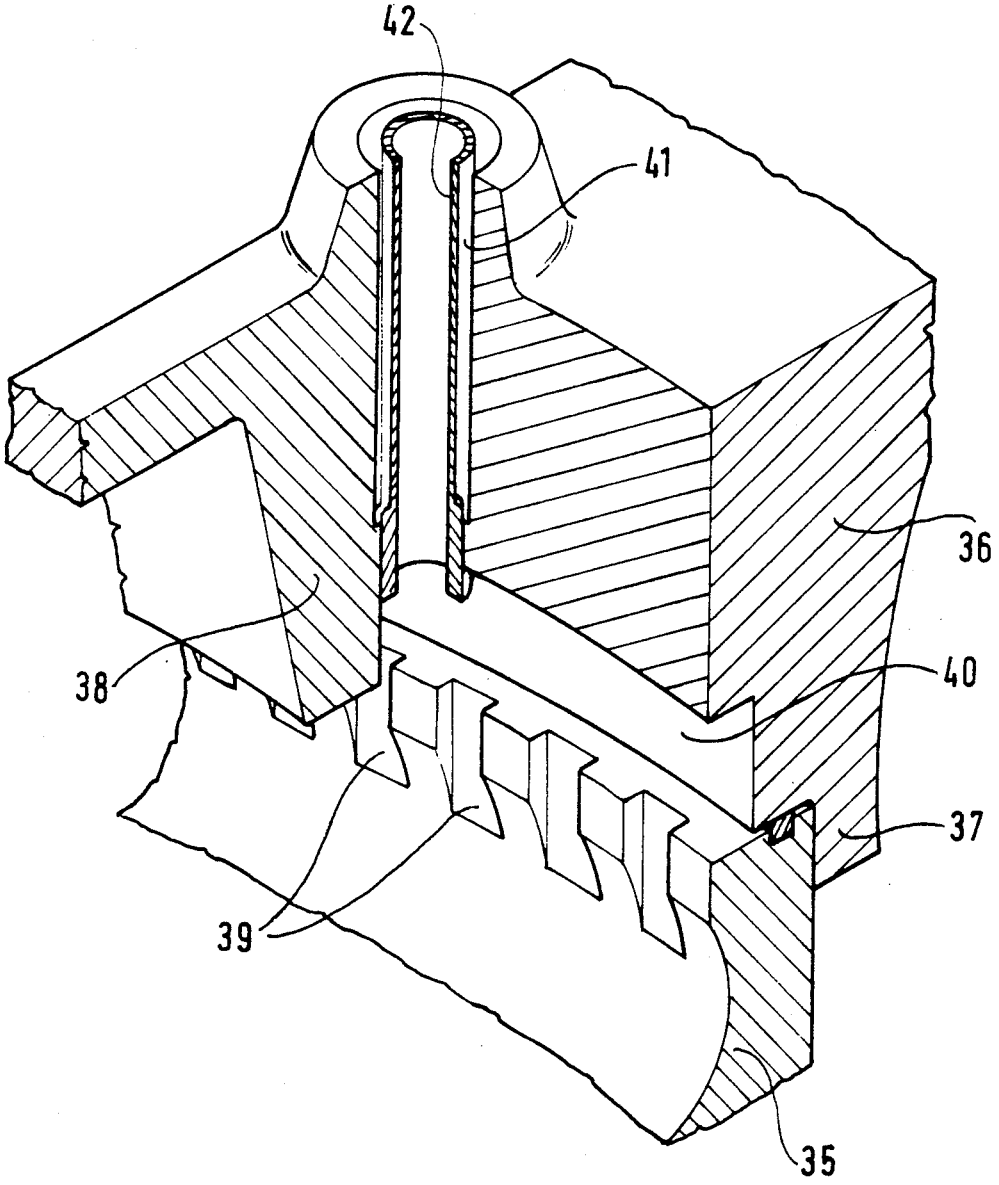
FIG. 6 is a perspective view showing a detail of the body shown in FIG. 5.

In the particular embodiment shown in FIGS. 3 to 6, the internal stator 57 includes projections 30 in the vicinity of the thermal protection means 10. Lateral ducts 31 and 32 and a radial duct 33 are provided through each projection (see FIG. 4).

The ducts 31, 32, and 33 are fed by a take-off 34 situated in the HP stream 6 and opening out into the inter-stator space 19 in the vicinity of the thermal projection means 10.

The projections 30 are symmetrical about the axis of the turbine.

The axial positioning means 11 are constituted by a first portion 35 fixed to the internal stator 57 resting against a portion 36 fixed to the external stator 9, between a bearing surface 37 and a counter bearing surface 38.

Grooves 39 are formed in the portion 35 and open out into a cavity 40 in the portion 36. A flue 41 is provided through the outer stator 9 to open out into the cavity 40. Each flue 41 is provided with dipping pipework 42 serving to exhaust steam to the flow rate adjusting device 27 (FIG. 2). The dipping pipework 42 serves to protect the external stator 9 from excessive convection.

Four cavities 40 are preferably disposed regularly around the axis of the turbine, each having its respective pipework 42. In each case this pipework 42 exhausts steam to a flow rate adjusting device 27. By adjusting each of these devices 27 individually, it is possible to adjust the cooling of the inter-stator space 19 in azimuth.

We claim:

1. An HP-MP steam turbine body comprising a rotor having an HP portion and an MP portion interconnected by an intermediate portion;

an HP internal stator co-operating with the HP portion of the rotor to define an HP stream;

an MP internal stator co-operating with the MP portion of the rotor to define an MP stream;

the HP internal stator and the MP internal stator being positioned axially inside an external stator by sealed axial positioning means situated around the MP stream in a plane which is at a distance from the inlet of said MP stream;

thermal protection means being situated around the HP stream in a plane at a distance from the inlet of said HP stream, said positioning means and said thermal protection means co-operating with the external stator and with the HP and MP internal stators to define an inter-stator space swept by steam;

HP admission means opening out to the inlet of the HP stream;

MP admission means opening out to the inlet of the MP stream and fed with a flow of steam taken off from the outlet of the HP stream and passed through a resuperheater device;

the inlets of the HP and MP streams being adjacent to each other and separated by sealing means supported by the internal stators and disposed in the intermediate portion of the rotor between the HP and MP portions;

wherein the HP internal stator and the MP internal stator constitute a single internal stator, and wherein the interstator space includes firstly steam admission means fed with steam taken from one of the last stages of the HP stream and opening out in the vicinity of the thermal protection means which isolate the inter-stator space from the outlet of the HP stream, and secondly steam exhaust means whose orifices are disposed in the vicinity of the axial positioning means, the said exhaust means being provided with flow adjustment means.

2. A turbine body according to claim 1, wherein the exhaust means are connected to the inlet of the resuperheater device feeding the MP stream.

3. A turbine body according to claim 1, wherein the exhaust means comprise a plurality of exhausts disposed symmetrically about the axis of the turbine, each connected to a respective flow adjustment device enabling the cooling of the inter-stator space to be adjusted in azimuth.

4. A turbine body according to claim 1, wherein at least a portion of the surface of the internal stator facing the intermediate space of the rotor between the HP and MP streams is provided with a coating of low thermal conductivity.

5. A turbine body according to claim 1, wherein the steam take-off means delivering said steam into the inter-stator space are constituted by ducts provided through projections on the internal stator and disposed symmetrically about the axis of the turbine.

6. A turbine body according to claim 1, wherein the means for exhausting steam from the inter-stator space comprise grooves provided in the portion of the axial positioning means which are fixed to the internal stator and opening out into cavities provided in the portion of the axial positioning means which are fixed to the external stator, flues passing through the external stator and opening out into said cavities, said flues being provided with dipping pipework connected to the inlet of the resuperheater device.

* * * * *